United States Patent [19]

Adamson

[11] 4,149,824

[45] Apr. 17, 1979

[54] BLADE CONTAINMENT DEVICE

[75] Inventor: Arthur P. Adamson, Cincinnati, Ohio

[73] Assignee: General Electric Company, Cincinnati, Ohio

[21] Appl. No.: 753,948

[22] Filed: Dec. 23, 1976

[51] Int. Cl.[2] ..... F16P 1/02

[52] U.S. Cl. ..... 415/9; 415/197; 415/214; 74/608; 60/39.09 R

[58] Field of Search ..... 415/9, 196, 197, 18, 415/121 G; 74/608, 609; 60/39.09 R

[56] References Cited

U.S. PATENT DOCUMENTS

| | | | |
|---|---|---|---|
| 1,698,514 | 1/1929 | Schmidt | 415/9 |
| 2,879,936 | 3/1959 | Faught | 415/121 G |
| 2,999,667 | 9/1961 | Morley | 415/196 |
| 3,203,180 | 8/1965 | Price | 415/9 |
| 3,602,602 | 8/1971 | Motta | 415/9 |

*Primary Examiner*—C. J. Husar

*Attorney, Agent, or Firm*—Robert C. Lampe, Jr.; Derek P. Lawrence

[57] ABSTRACT

A device is provided for containing blades of rotating turbomachinery comprising a high-strength ring supported in radial spacial relationship over the blade tips by means of a stationary support structure. The ring is supported in such a manner that it is capable of spinning with respect to the support structure when acted upon by a predetermined blade force.

14 Claims, 6 Drawing Figures

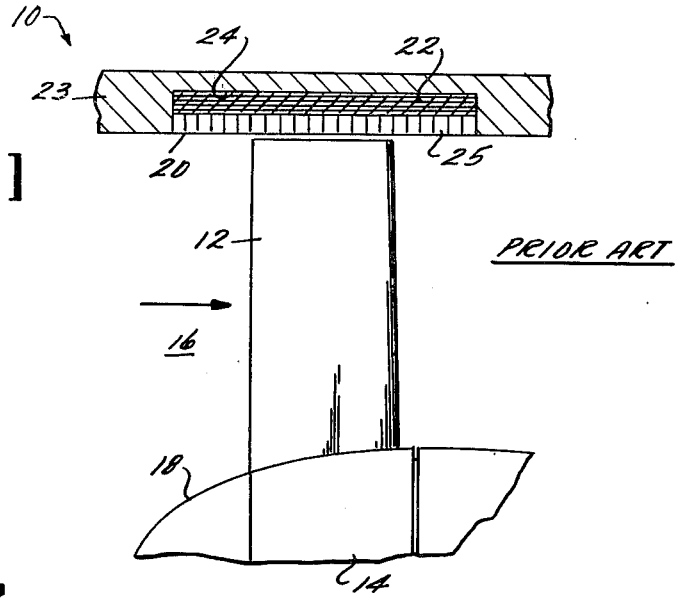
Fig 1
Fig 2
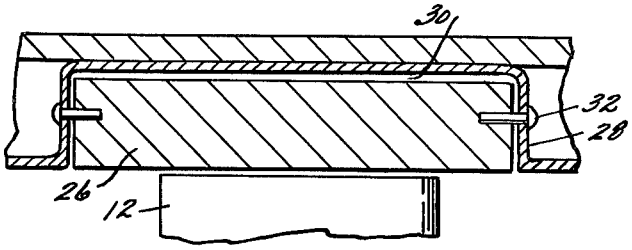
Fig 3
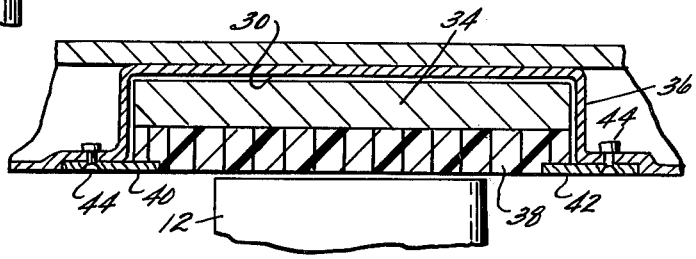
Fig 4
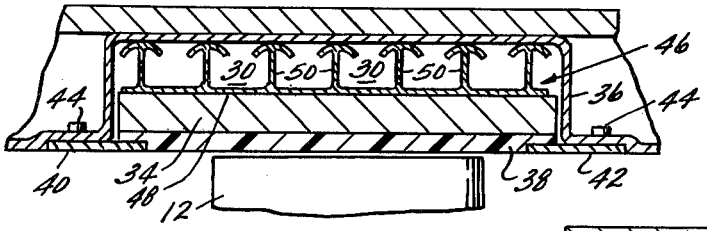
Fig 5
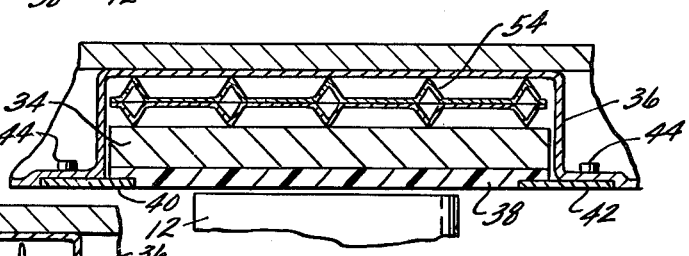
Fig 6
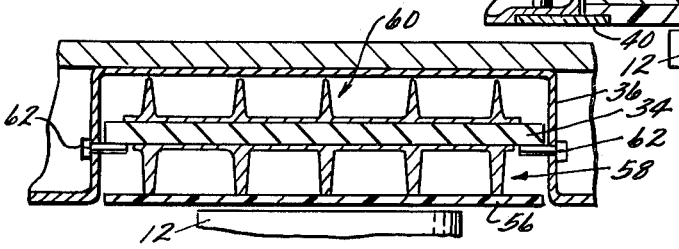

BLADE CONTAINMENT DEVICE

BACKGROUND OF THE INVENTION

This invention pertains to rotating turbomachinery and, more particularly, to a device for containing rotor blades by absorbing the rotational energy thereof when inadvertently contacted by the blades.

Gas turbine engine turbomachinery typically operates at high rotational speeds and thus possesses high kinetic energy, even when the rotating structures are fabricated out of modern lightweight alloys or composites. At times, entire rotor blades or parts thereof have been inadvertently shed from rotors due to the impact of foreign objects entrained in the propulsive gas stream or from any of a number of other well-known causes. Since the shed blades possess such a high kinetic energy, means should be provided to contain them within the turbomachinery to minimize further secondary damage. Hence, there is usually provided a stationary, rigid containment ring which circumscribes the rotating blade tips in radial spacial relationship. Typically, this ring is very heavy and is constructed of a high-strength metal. However, as the released blade contacts this containment ring, it is impacted, in turn, by the following blades which are still attached to the rotor and violent forces are transmitted to the ring, the blades and their associated support structure. In particular, large circumferential torque loads are transmitted to the internal engine frame and large bending moments are created in the rotor blades. In the event that these members become over-stressed, the possibility of secondary damage exists even though, strictly speaking, the released blade has been contained. It is therefore desirable to provide a means for absorbing in a more gradual manner the energy from a released turbomachinery blade, thereby limiting secondary damage and maintaining the various forces and torques at a lower level.

Closely akin to the problem of inadvertently released blades is the situation where a temporary imbalance of, or transient load upon, the turbomachinery rotor temporarily reduces the concentricity between the rotor blades and the circumscribing containment ring. Since turbomachinery efficiency is an inverse function of clearance, the clearance between the blade tips and the containment ring is very tight so that small variations in concentricity can cause a blade to rub against the ring. When the rub is severe, large bending moments can be created in the blade. If these stresses are large enough, blade failure can occur and the aforementioned secondary damage results. It is therefore desirable to provide a more forgiving containment structure which will gradually absorb the rotational energy of a rubbing rotor rather than contribute toward the production of large stresses in the rotor blades.

SUMMARY OF THE INVENTION

Accordingly, it is the primary object of the present invention to provide a containment device for gradually absorbing the energy of a released turbomachinery blade in order to minimize secondary damage.

It is another object of the present invention to provide a containment device which will gradually absorb the rotational energy of a rotor blade which comes into rubbing contact therewith.

It is yet another object of the present invention to provide an improved method for containing blades of rotating turbomachinery.

These and other objects and advantages will be more clearly understood from the following detailed description, drawings and specific examples, all of which are intended to be typical of rather than in any way limiting to the scope of the present invention.

Briefly stated, in one embodiment the above objectives are accomplished by a high-strength ring supported in radial spacial relationship over a stage of rotatable turbomachinery blades by a stationary support structure. The ring is mounted within the support structure in such a manner that when impacted or contacted by a turbomachinery blade with a predetermined impact force, energy associated with the blade is transferred to the ring which is permitted to spin within the stationary support structure. The spinning ring absorbs energy at a low rate, gradually slowing the blade without producing large circumferential torque or bending loads in the turbomachinery.

In an alternative embodiment, energy absorbing fins on the ring maintain the ring in radial spacial relationship with the support structure. The clearance space thus formed between the ring and the support structure permits the ring to bulge locally under impact, thus crushing the fins and absorbing a portion of the blade kinetic energy. Since the fins are of such a length that the bulge is contained within the clearance space, the ring is still free to spin and to further absorb blade energy without damaging the engine support structure.

BRIEF DESCRIPTION OF THE DRAWINGS

While the specification concludes with claims particularly pointing out and distinctly claiming the subject matter which is regarded as part of the present invention, it is believed that the invention will be more fully understood from the following description of the preferred embodiments which is given by way of example with the accompanying drawings, in which:

FIG. 1 is a simplified schematic cross-sectional view of the fan portion of a gas turbine engine embodying a containment device fabricated according to the prior art teachings;

FIG. 2 is an enlarged view of the outer portion of the turbomachine of FIG. 1 depicting an improved containment device constructed according to the present invention; and FIGS. 3 through 6 are views similar to FIG. 2 depicting alternative embodiments of the present invention.

DESCRIPTION OF THE PREFERRED EMBODIMENTS

Referring to the drawings wherein like numerals correspond to like elements throughout, attention is first directed to FIG. 1 wherein a portion of a gas turbofan engine indicated generally at 10 and constructed according to the prior art teachings is diagrammatically shown. The engine is shown to include a stage of fan blades 12, only one blade of which is shown for clarity, mounted for rotation upon a rotatable hub 14. Air enters the fan duct 16 defined, in part, by aerodynamic spinner 18 and flow path defining wall 20 and is initially compressed by the rotatable fan blades 12. The air may be subsequently further compressed, combusted and discharged through a nozzle to generate propulsive thrust in the usual manner of a gas turbine engine. However, the present invention is directed primarily to those portions of a gas turbine engine containing rotating turbomachinery such as the fan blades of FIG. 1.

In order to contain the blades 12 in the event one of them should be shed, a high-strength containment ring 22 is usually disposed around the tips of the blades in relatively close proximity thereto. Ring 22 is normally seated within a cavity 24 formed within a stationary structural support member 23 and rigidly connected thereto as by bolting or welding. A layer of low-density material 25 such as open cell honeycomb completes the aerodynamic flow path over the blade tips and provides a buffer for the blades in the event of an inadvertent rub. Ring 22 is generally very heavy in order to resist the high kinetic energy associated with a rotating blade. However, if a released blade penetrates the low-density rub material 25 and contacts ring 22, it is likely that the following blades of the stage will also contact either the ring 22 or the released blade, and violent forces may be transferred to the support structure 23, blades 12 and rotatable hub 14 as discussed hereinabove.

FIG. 2 depicts a novel approach to blade containment. Therein a containment ring 26 of high-strength material circumscribes blades 12 in radial spacial relationship therewith. The ring is supported by a rigid annular support member 28 connected to the turbomachinery frame (not shown), the support member being provided with a cavity 30 for receiving the ring in sliding relationship. Shear pins 32 retain the ring stationary with respect to the support member during normal engine operation. However, if a blade contacts the ring 26 with a predetermined force, the rotational energy of the blade will cause the pins 32 to shear and the ring to spin within cavity 30, thereby absorbing energy at a low rate without transmitting any large circumferential torques to the engine frame. Further, the blade will be gradually slowed down, thus transmitting decreased loads to the ring and the blade. In essence, a portion of the rotational kinetic energy of the blade is transferred into rotational kinetic energy of the containment ring. Since the cavity 30 is slightly larger than the containment ring, the ring should be free to spin even if it undergoes moderate amounts of distortion due to blade impact.

FIG. 3 depicts a variation of the embodiment of FIG. 2 wherein increased clearance is provided between the tip of blades 12 and a containment ring 34 which, like ring 26 of FIG. 2, is supported by a modified structural support 36 for possible rotation therein under impact or rub. The clearance space is partially filled with a layer of low-density, energy-absorbing material 38 such as open cell honeycomb or honeycomb filled with a low-density matrix material such as an epoxy resin which is preferably bonded to the containment ring 34. The honeycomb and ring are again free to rotate except for the presence of a pair of retaining rings 40, 42 which are attached as by flush rivets 44 to support structure 36, thereby entrapping the honeycomb and ring about their entire circumference. Retaining rings 40, 42 are an alternative to shear pins 32 of FIG. 2 and it is to be understood that as used herein the two means for retention are interchangeable. The internal layer of honeycomb 38 provides an important improvement over the embodiment of FIG. 2 in that the crushing of the honeycomb itself upon contact by a blade absorbs a quantum of energy. Furthermore, the crushing of the honeycomb tends to accelerate the spinning of the ring at a more gradual rate and, hence, lower forces are involved.

In FIG. 4, a modification of the embodiment of FIG. 3 is shown wherein an annular spacer 46 is positioned within cavity 30 to maintain the containment ring 34 at a predetermined radial distance from the rigid structural support member 36. The spacer comprises an annular base portion 48 supporting a plurality of integral, upstanding, circumferentially extending webs 50. An arcuate cap 52 on the radially outer end of each web provides a larger rubbing interface between the web and support member. Spacer 46 permits the containment ring to bulge locally under impact and to crush the webs 50. The length of the webs permits adequate space for the bulge to remain within the clearance space, allowing the containment ring to spin without damaging the support structure 36. It may be recognized that the webs 48 could be replaced by open-cell honeycomb or any other energy-absorbing, low-density material. Accordingly, FIG. 5 depicts an embodiment wherein a collapsible, diamond-shaped spacer 54 replaces the webbed spacer 46 of FIG. 4.

FIG. 6 depicts an embodiment wherein a lightweight, non-containing tip rub shroud 56 is supported in radial spacial relationship with containment ring 34 by a webbed spacer 58. In a manner similar to the embodiment of FIG. 4, the containment ring is maintained in spacial relationship with support structure 36 by a second webbed spacer 60. In effect, clearance spaces are thus provided both inside and outside of the containment ring, allowing room for debris to move radially out of the duct 16 (FIG. 1) and then to be contained by the containment ring, with the gaps created by spacer 60 performing the same function as the gap created by the spacer 46 of FIG. 4. Permitting the debris to move radially outwardly before it is significantly slowed down will greatly minimize damage due to the following blades impacting an initially released blade. Note also that a third method of containment ring retention is provided by means of pins 62 which support the radially interior edges of the containment ring 34 but yet allow the ring to spin when impacted or rubbed by a rotor blade.

Thus, means and method have been provided for containing the blades of rotating turbomachinery and for reducing the forces associated with a rubbing or released blade. In all embodiments, the stage of rotatable turbomachinery blades has been surrounded in radial spacial relationship with a containment ring which is so mounted in a stationary support structure that it is free to rotate when contacted by a blade.

It will become obvious to one skilled in the art that certain changes can be made to the above-described invention without departing from the broad inventive concepts thereof. For example, numerous variations and methods of retention of the rotatable containment ring within a support structure are possible and only three such schemes have been depicted herein. Additionally, the composition of the containment ring can comprise a high-strength metal or metal alloy, or a woven structure of high-strength composite filaments embodied in a lightweight matrix material, providing that the ring is free to rotate under a predetermined blade load. In this regard, the fabrication of the shear pins 32 (FIG. 2) can be controlled such that the onset of spin is delayed until a predetermined blade force acts upon the ring. It is intended that the appended claims cover these and all other variations in the present invention's broader inventive concepts.

Having thus described the invention, what is claimed as novel and desired to be secured by Letters Patent of the United States is:

I claim:

1. A device for containing blades of rotating turbomachinery comprising:

a high-strength ring for surrounding in radial spacial relationship a stage of rotatable turbomachinery blades; and support means disposed generally outwardly of said ring for supporting said ring in a manner such that when the rotating blades contact said ring blade rotational energy is absorbed by imparting spin to said ring with respect to said support means.

2. The device as recited in claim 1 wherein said ring is faced with a layer of relatively low density rub material in close proximity over the tips of the blades.

3. The device as recited in claim 1 further comprising retaining means to hold said ring fixed with respect to said support means until acted upon by a predetermined blade force.

4. The device as recited in claim 3 wherein said retaining means comprises a shear pin.

5. The device as recited in claim 1 wherein said support means includes a cavity formed therein for receiving said ring, and wherein said device further comprises retaining means to hold said ring fixed within said cavity until acted upon by a predetermined blade force.

6. The device as recited in claim 5 further comprising first spacer means disposed within said cavity between said ring and said support means for establishing a clearance therebetween.

7. The device as recited in claim 6 wherein said first spacer means is of the energy-absorbing, low-density variety.

8. The device as recited in claim 7 wherein said first spacer means includes a plurality of radial webs extending substantially between said ring and said support means.

9. The device as recited in claim 7 wherein said first spacer means includes honeycomb material.

10. The device as recited in claim 6 further comprising second spacer means disposed within said cavity between said ring and the turbomachinery blade tips for establishing a clearance therebetween.

11. The device as recited in claim 10 wherein said second spacer means carries a layer of relatively low-density rub material in close proximity over the tips of the turbomachinery blades.

12. A device for containing blades of rotating turbomachinery comprising a high-strength ring supported in radial spacial relationship over a stage of rotatable turbomachinery blades by support means, and wherein said ring is capable of spinning with respect to said support means when acted upon by a predetermined blade force.

13. A device for containing blades of rotating turbomachinery comprising a high-strength ring carried in radial spacial relationship over a stage of rotatable turbomachinery blades by support means which permit said ring to spin when contacted by the rotating blades such that the blade rotational energy is absorbed primarily by said ring instead of said support means.

14. In a method of containing blades or rotating turbomachinery, the steps of:

surrounding in radial spacial relationship a stage of rotatable turbomachinery blades with a high-strength ring; and supporting said ring in such a manner that said ring is free to rotate when acted upon by a predetermined blade force, thereby absorbing blade rotational energy.

* * * * *